US006167786B1

(12) United States Patent
Kilgore

(10) Patent No.: US 6,167,786 B1
(45) Date of Patent: Jan. 2, 2001

(54) SOCKET WRENCH DRIVEN ADJUSTABLE JAW CROW FOOT WRENCH

(75) Inventor: Gary Hartman Kilgore, San Antonio, TX (US)

(73) Assignee: Motorbay Company, San Antonio, TX (US)

( * ) Notice: Under 35 U.S.C. 154(b), the term of this patent shall be extended for 0 days.

(21) Appl. No.: 09/377,940

(22) Filed: Aug. 20, 1999

(51) Int. Cl.[7] ..... B25B 13/14
(52) U.S. Cl. ..... 81/142; 81/129; 81/134
(58) Field of Search ..... 81/129, 129.5, 81/134, 135, 142, 139, 170

(56) References Cited

U.S. PATENT DOCUMENTS

| | | | | |
|---|---|---|---|---|
| 979,348 | * | 12/1910 | Smith | 81/135 X |
| 4,454,791 | * | 6/1984 | Seward, III | 81/142 X |
| 4,548,104 | | 10/1985 | Hendricks . | |
| 4,898,052 | | 2/1990 | Kang . | |
| 5,222,419 | | 6/1993 | Spector . | |
| 5,301,576 | | 4/1994 | Nye . | |
| 5,535,650 | | 7/1996 | McNatt . | |
| 5,644,957 | | 7/1997 | Gustafson . | |
| 5,746,099 | | 5/1998 | Janson . | |

* cited by examiner

*Primary Examiner*—David A. Scherbel
*Assistant Examiner*—Anthony Ojini

(57) ABSTRACT

A socket wrench driven adjustable jaw crow foot wrench is an assembly of four primary components: a chassis; a carriage; a ratchet; and a pawl. The chassis has a stationary jaw at a first end, a track extending from the first end to a second end of the chassis; and a cavity which opens to the track and opposing sides of the chassis. In a preferred embodiment of the tool, a female receiver for a socket wrench is provided on an end of the tool opposite the track. The carriage bears a jaw designed to mate to the stationary jaw of the chassis. The carriage is provided with a rack. Said carriage is designed to travel in the track provided on the chassis. The ratchet is provided with a female socket wrench receiver, and is located in the cavity provided in the chassis. The ratchet is juxtapositioned to communicate with the rack on the carriage. The pawl is located in the cavity provided in the chassis and juxtapositioned to communicate with the ratchet.

2 Claims, 4 Drawing Sheets

SOCKET WRENCH DRIVEN ADJUSTABLE JAW CROW FOOT WRENCH

BACKGROUND OF THE INVENTION

1. Field of the Invention

The novelty disclosed in this document pertains to hand tools. More narrowly, it applies to wrenches with adjustable jaws and driven by a socket wrench.

The jaw of the conventional adjustable jaw wrench will displace incrementally when force is exerted on a fastener. This defect is of no consequence, when the fastener being manipulated responds to torque. However, if a fastener will not respond to rotational force exerted by the jaws of a wrench, the load bearing surfaces of the fastener will begin to fail. The resulting disfigurement of these surfaces eventually precludes rotation of the fastener with a wrench.

The device described in this document provides an enhanced gripping means that can apply compression force to opposing sides of a fastener, while the fastener is being torqued.

2. Description of the Related Art Including Information Disclosed Under 37 CFR 1.97 and 1.98

Examining the patent record, I concentrated on documents pertaining to adjustable jaw wrenches with gripping enhancements. When the criteria was narrowed to adjustable jaw wrenches that can apply compression force to a fastener, McNatt's U.S. Pat. No. 5,535,650 was the only reference I found.

McNatt's adjustable plier wrench hand tool, U.S. Pat. No. 5,535,650 provides a locking lever that engages an assembly of a worm gear and lower jaw, allowing the lower jaw to be pressed to the fastener.

The following patents are related to the subject matter, however they do not meet the criterion of describing an enhanced gripping means that can apply compression force to opposing sides of a fastener, while the fastener is being torqued.

| Prior Art Cited | | |
|---|---|---|
| 5,535,650 | McNatt | JuIy 16, 1996 |
| 4,548,104 | Hendricks | Oct. 22, 1985 |
| 5,644,957 | Gustafson | July 8, 1997 |
| 5,301,576 | Nye | April 12, 1994 |
| 5,222,419 | Spector | June 29, 1993 |
| 4,898,052 | Kang | Feb. 6, 1990 |
| 5,746,099 | Janson | May 5, 1998 |

OBJECTS AND ADVANTAGES

The objective of the improvements disclosed in this document is to provide enhanced gripping means with the potential to compress opposing sides of a fastener, while the fastener is being torqued.

The advantage of the improvements described in this document is found in minimizing damage to the gripping surfaces of a fastener, which is not properly responsive to rotation force, while torque is being applied.

BRIEF SUMMARY OF THE INVENTION

The improvements found in this adjustable jaw wrench pertain to: increased lateral grip on a fastener; and leverage selectability.

The adjustable wrench improvement disclosed in this document is the inclusion of a ratchet to manipulate the lower jaw of the wrench. The benefit provided by this element is the ability to apply a grip on a fastener that is exponentially greater than the grip that can be attained by manipulating a lower jaw with a worm gear.

Increased lateral grip on a fastener increases the likelihood that a fastener that is resisting torque may rotate without substantially disfiguring.

Leverage selectability is the province of socket, not adjustable, wrenches. This tool provides the options of: selecting the length of the lever used to apply torque; selecting the orientation of the lever relative to the orientation of the jaws; applying marginally increasing lateral force to the bearing surfaces of the fastener while attempting to rotate it, by using female receiver 43 for rotation; applying constant lateral force to the bearing surfaces of the fastener while attempting to rotate it, by using female receiver 14 for rotation; and installing levers in both female receivers 43 and 14.

OPERATION

The adjustable wrench described in this document is used in conjunction with a socket wrench, either ratcheting or breaker bar. First, an appropriate length of socket wrench is selected. The socket wrench is installed in female receiver 43. The jaws of the adjustable wrench are placed against opposing sides of a fastener, then with the socket wrench installed at female receiver 43, the jaws are pressed to the opposing sides of the fastener. The socket wrench may remain in female receiver 43 if the intent is to apply marginally greater compressive force to the bearing surfaces of the fastener while torquing the fastener. The socket wrench may be moved to female receiver 14 if the intent is to apply constant compressive force to the bearing surfaces of the fastener while torquing the fastener. To release the adjustable wrench from the fastener, the pawl 40 is depressed. There will be occasions when the tension at the juncture of pawl 40 and the ratchet 42 creates enough friction to preclude manipulation of the pawl 40 by hand depression alone. This is why the preferred embodiment of the wrench includes a pawl that may be struck against the chassis 10 to release the ratchet.

REFERENCE NUMERALS IN DRAWINGS

1—first end of chassis
2—second end of chassis
3—third end of chassis
4—fourth end of chassis
5—fifth end of chassis
6—sixth end of chassis
8—socket wrench/ratchet engagement means aperture
10—chassis
11—track
14—socket wrench/chassis engagement means
15—stationary jaw
18—pawl access aperture
20—carriage
21—movable jaw
22—second end of carriage
23—first end of carriage
24—rack
40—pawl
41—pawl pivot point
42—ratchet
43—socket wrench receiving means
45—pawl attachment means
50—pawl engagement means

DETAILED DESCRIPTION OF THE INVENTION

Figure 1:
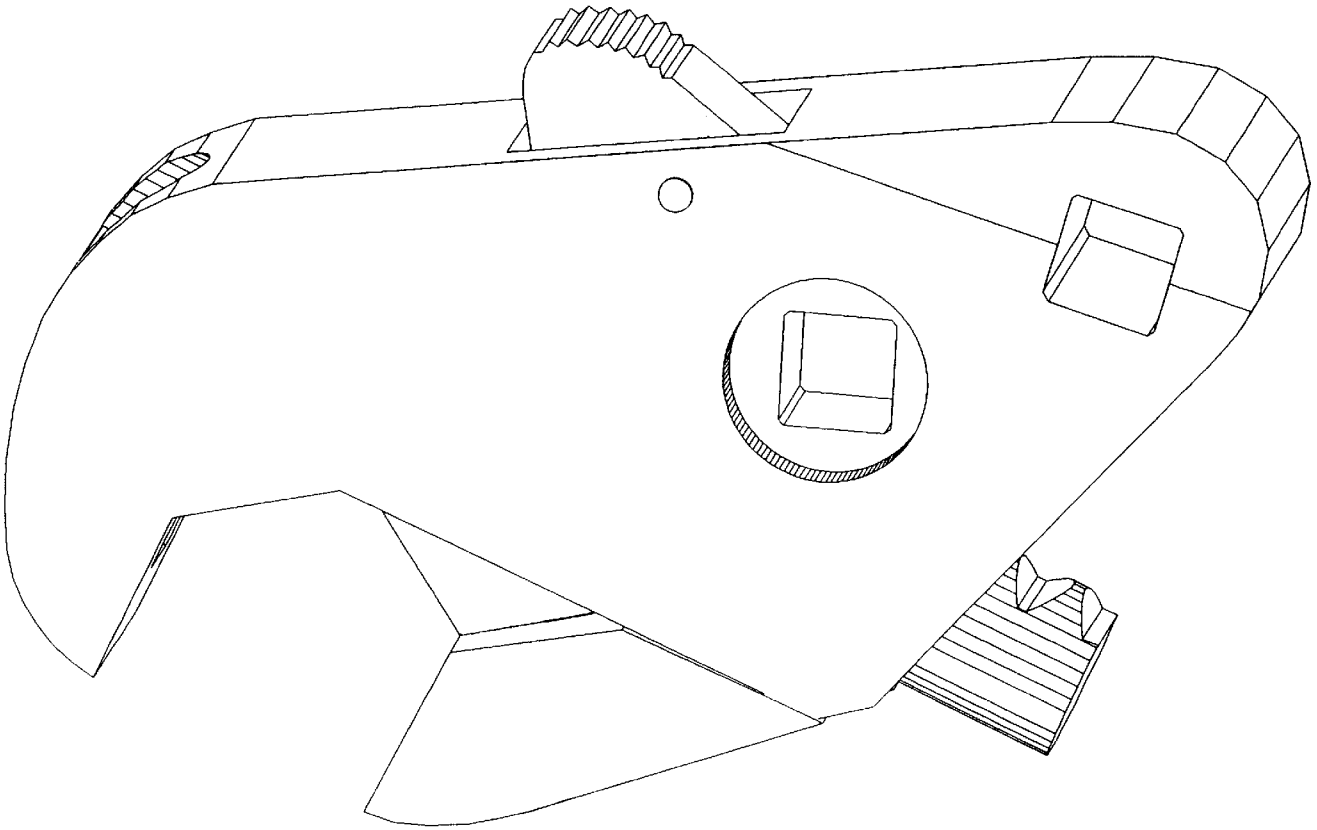
FIG. 1 a first perspective view of a preferred embodiment of the tool.
Figure 2:
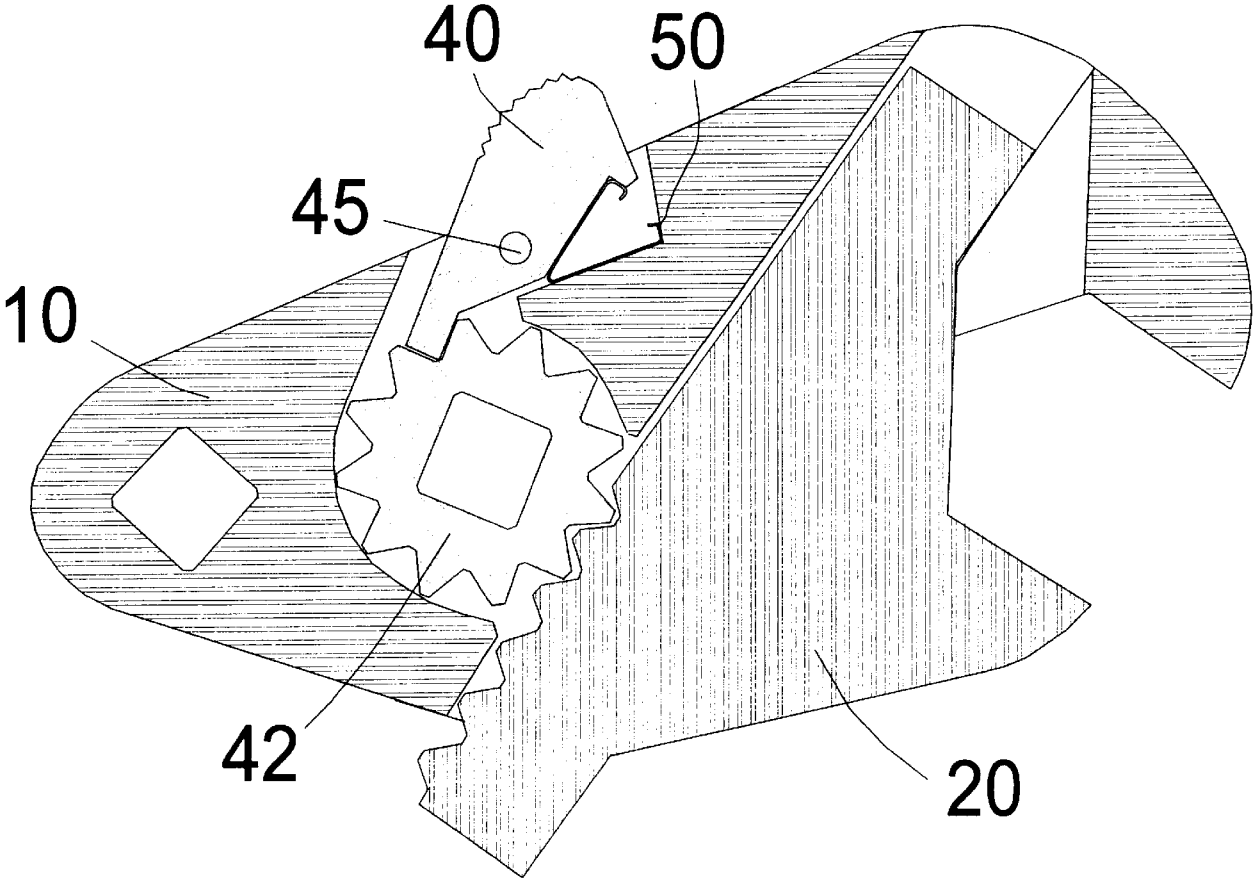
FIG. 2 a cross section view of a preferred embodiment of the tool illustrating preferred embodiments and locations of: chassis 10; carriage 20; pawl 40; ratchet 42; pawl attachment means 45; and pawl engagement means 50.
Figure 3:
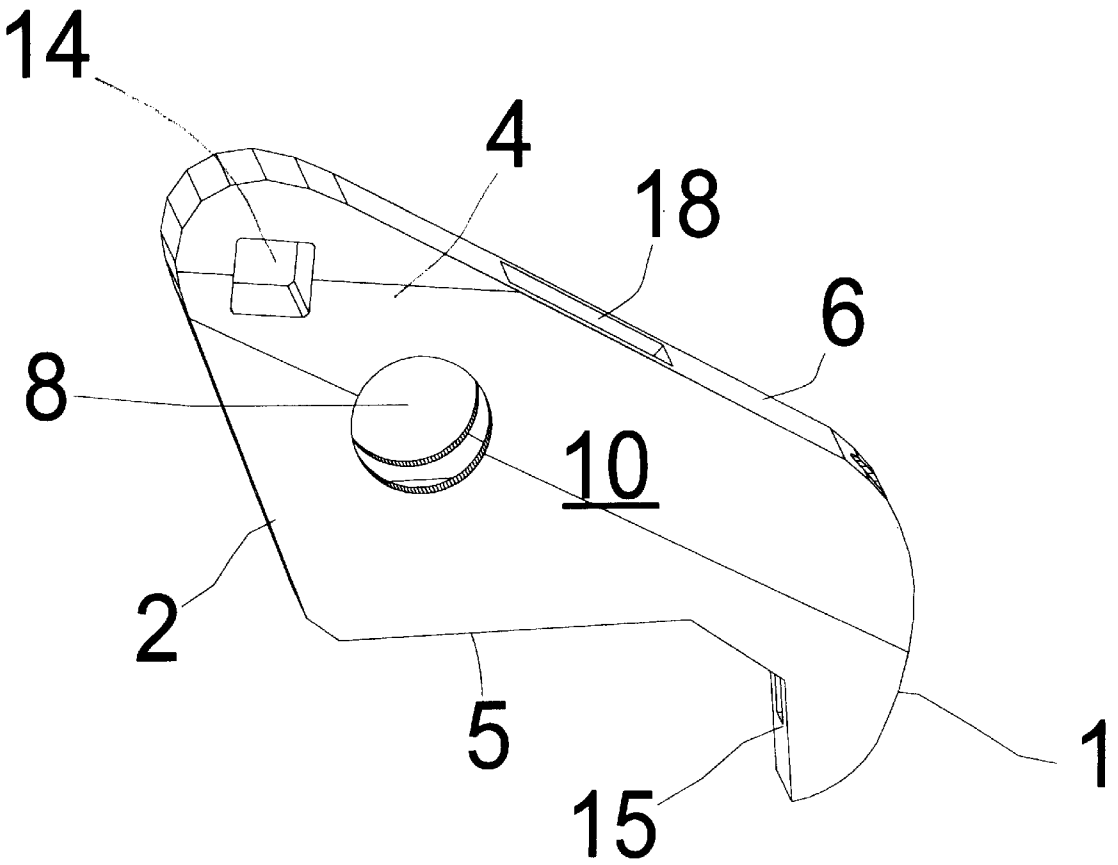
FIG. 3 a perspective view of the chassis 10 illustrating a preferred embodiment: first end of chassis 1; second end of chassis 2; fourth end of chassis 4; fifth end of chassis 5; sixth end of chassis 6; socket wrench engaging means access aperture 8; socket wrench/chassis engagement means 14; stationary jaw 15; and pawl access aperture 18.
Figure 4:
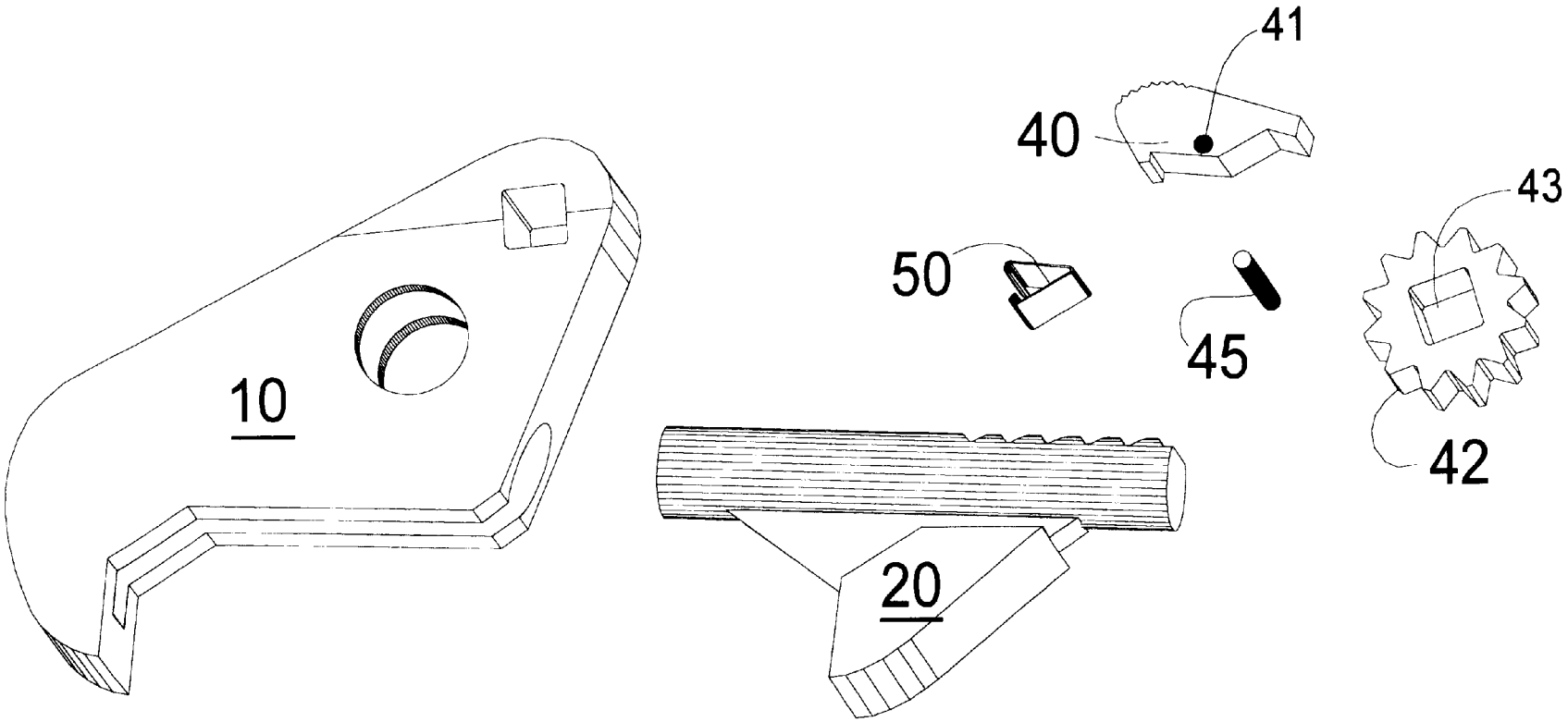
FIG. 4 an exploded view of a preferred embodiment of the tool illustrating preferred embodiments of the components: chassis 10; carriage 20; pawl 40; pawl pivot point 41; pawl attachment means 45; pawl engagement means 50; ratchet 42; and socket wrench receiving means 43.

The adjustable wrench illustrated according to the invention is shown to have a chassis 10 bearing a stationary jaw 15, a carriage 20 bearing a movable jaw 21, a ratchet 42, and a pawl 40.

The chassis 10 is shown to have a stationary jaw 15 located on a first end 1. A track 11 extends from a first end I to a second end 2 of the chassis. A cavity containing a ratchet 42 and a pawl 40 opens to: the track 11; a third end 3; a fourth end 4, and a sixth end 6 of the chassis. The cavity opening is labeled 8 on the third and fourth ends. The cavity opening is labeled 18 on the sixth end. In one embodiment of the tool, a female means 14 for engaging a socket wrench is located on the chassis 10.

The carriage 20 is shown to have a movable jaw 21 oriented toward a first end 23 of the carriage. A rack 24 is provided along a length of the carriage to provide a means communicate with the ratchet 42. The carriage travels in the track 11 provided on the chassis 10. The carriage is oriented in the track with a first end of the carriage 23 positioned relative to a first end of the chassis 1, and a second end of the carriage 22 positioned relative to a second end of the chassis 2.

The ratchet 42 is shown to have a female means 43 for receiving a socket wrench. The ratchet is positioned in a cavity in the chassis. The cavity opens to the track 11; a third end 3; a fourth end 4, and a sixth end 6 of the chassis. The cavity opening is labeled 8 on the third and fourth ends. The cavity opening is labeled 18 on the sixth end. The pawl 40 is juxtapositioned with the ratchet in the cavity in the chassis.

The present invention has been described in some detail by way of illustrations for purposes of clarity and understanding, it will, of course, be understood that various changes and modifications may be made in the form, details, and arrangements of the parts without departing from the scope of the invention as set forth in the claims.

I claims:

1. An adjustable jaw wrench comprising:

a chassis having a stationary jaw at a first end, a track extending across said chassis from said first end to a second end; a carriage moves within said track, said carriage provided with a jaw, said carriage provided with a rack; a cavity provided within said chassis;

a ratchet positioned within said cavity and in communication with said rack; said ratchet provided with a female means of accepting a socket wrench; and a pawl juxtapositioned to communicate with said ratchet.

2. An adjustable jaw wrench according to claim 1 further includes:

a second female means located on said chassis.

* * * * *